US009511252B1

(12) United States Patent
Ho et al.

(10) Patent No.: US 9,511,252 B1
(45) Date of Patent: Dec. 6, 2016

(54) COLLAPSIBLE EXERCISE DEVICE

(71) Applicants: Wei-Teh Ho, Taipei (TW); Willy Wei Yu Ho, Taipei (TW)

(72) Inventors: Wei-Teh Ho, Taipei (TW); Willy Wei Yu Ho, Taipei (TW)

( * ) Notice: Subject to any disclaimer, the term of this patent is extended or adjusted under 35 U.S.C. 154(b) by 0 days.

(21) Appl. No.: 14/834,353

(22) Filed: Aug. 24, 2015

(51) Int. Cl.

| | |
|---|---|
| ***A63B 71/00*** | (2006.01) |
| ***A63B 21/00*** | (2006.01) |
| ***A63B 21/068*** | (2006.01) |
| ***A63B 23/02*** | (2006.01) |
| ***A63B 23/12*** | (2006.01) |

(52) U.S. Cl.
CPC ..... *A63B 21/4035* (2015.10); *A63B 21/0004* (2013.01); *A63B 21/00047* (2013.01); *A63B 21/068* (2013.01); *A63B 21/4039* (2015.10); *A63B 21/4045* (2015.10); *A63B 23/0205* (2013.01); *A63B 23/1227* (2013.01); *A63B 23/1236* (2013.01); *A63B 2210/50* (2013.01)

(58) Field of Classification Search
CPC ..... A63B 21/4035; A63B 21/4045; A63B 21/4039; A63B 21/068; A63B 21/0004; A63B 21/00047; A63B 2210/50; A63B 23/1227; A63B 23/0205; A63B 23/1236
See application file for complete search history.

(56) References Cited

U.S. PATENT DOCUMENTS 5,941,803 A * 8/1999 Chamberlain ..... A63B 21/0552 482/51
6,090,023 A * 7/2000 Liu ..... A63B 21/0004 482/130
6,592,500 B1 * 7/2003 McBride ..... A63B 21/0004 482/140
7,341,547 B2 * 3/2008 Liao ..... A63B 21/0004 482/140
8,790,227 B2 * 7/2014 Meister ..... A63B 23/0494 482/140
9,238,157 B2 * 1/2016 Chuang ..... A63B 21/055
9,278,244 B2 * 3/2016 Chuang ..... A63B 21/055

FOREIGN PATENT DOCUMENTS

CN 201894807 U 7/2011

* cited by examiner

*Primary Examiner* — Loan H Thanh
*Assistant Examiner* — Megan Anderson
(74) *Attorney, Agent, or Firm* — Blakely, Sokoloff, Taylor & Zafman LLP

(57) ABSTRACT

An exercise machine including a support frame, one or more arched frames and a grip frame detachably coupled together in a circular sequence is described. A locking control mechanism can allow detaching or attaching one end of the grip frame from the arched frames to configure the machine in an operating configuration or a collapsed configuration. The arched frames in an operating configuration are arranged substantially parallel to each other to allow a user positioned in between the arched frames to perform exercise movements. When one end of the grip frame is detached from the arched frame, the arched frames, the grip frame and the support frames may be folded (or foldable) into a collapsed configuration with the arched frames substantially stacked together covering each other. The arched frames, the support frame and the grip frame can remain coupled in sequence in the collapsed configuration.

7 Claims, 7 Drawing Sheets

COLLAPSIBLE EXERCISE DEVICE

FIELD OF INVENTION

The present invention relates generally to an exercising machine, and in particular, to a foldable exercise device for assisting sit-up or push-up movements.

BACKGROUND

With the growing awareness of health problems caused by lack of exercise, the popularity of exercise machines has steadily increased. For example, sit-up devices may be used to facilitate exercise movements for strengthening the abdominal muscles. Multi-function sit-up devices can be configured to support additional forms of exercise movements. However, these devices are mostly bulky, hard to assemble, and structured without portability considerations.

Therefore, there is a need to provide better exercising machines.

SUMMARY OF THE DESCRIPTION

An exercise machine can include a support frame, one or more arched frames and a grip frame detachably coupled together in a circular sequence with a locking control mechanism to detach or attach one end of the grip frame from the arched frames to configure the machine in an operating configuration or a collapsed configuration. The arched frames in an operating configuration are arranged substantially parallel to each other to allow a user position herself/himself in between the arched frames to perform exercise movements. When one end of the grip frame is detached from the arched frame, the arched frames, the grip frame and the support frames may be folded into a collapsed configuration with the arched frames substantially stacked together covering each other. The arched frames, the support frame and the grip frame can remain coupled in sequence in the collapsed configuration.

Other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The present invention is illustrated by way of examples and not limitations in the figures of the accompanying drawings, in which like references indicate similar elements and in which.

DETAILED DESCRIPTION

In the following description, numerous specific details are set forth, such as examples of external surfaces, named components, connections between components, etc., in order to provide a thorough understanding of the present invention. It will be apparent, however, to one skilled in the art that the present invention may be practiced without these specific details. In other instances, well-known components or methods have not been described in detail but rather in a block diagram in order to avoid unnecessarily obscuring the present invention. Further, specific numeric references such as first, second, third, etc., may be made. However, the specific numeric references should not be interpreted as a literal sequential order but rather interpreted as references to different objects. Thus, the specific details set forth herein are merely exemplary. The specific details may be varied from and still be contemplated to be within the scope of the present invention.

Reference in the specification to "one embodiment" or "an embodiment" means that a particular feature, structure, or characteristic described in connection with the embodiment can be included in at least one embodiment of the invention. The appearances of the phrase "in one embodiment" in various places in the specification do not necessarily all refer to the same embodiment.

Figure 1:
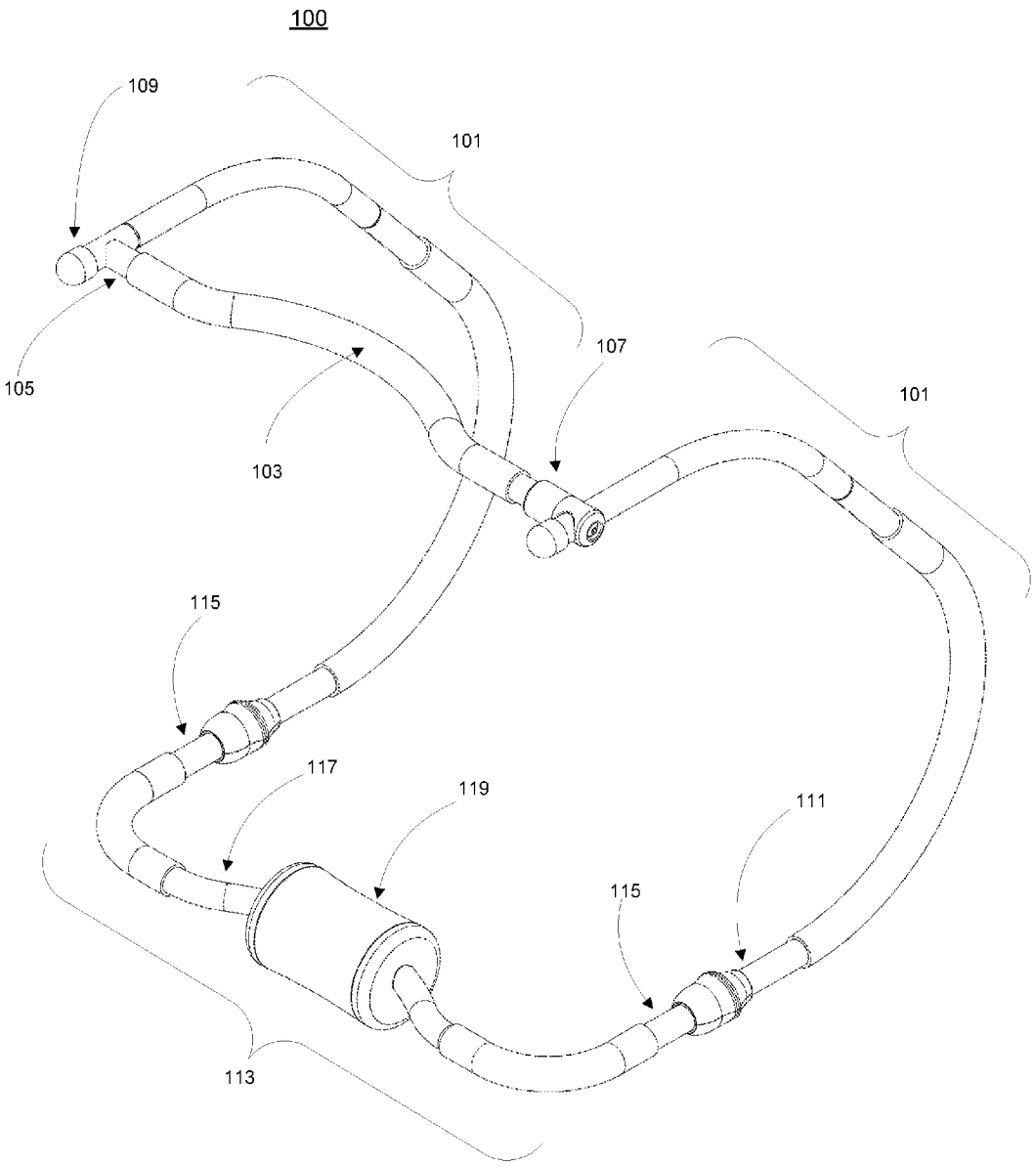
FIG. 1 is a perspective diagram illustrating an embodiment of a collapsible exercise device.

FIG. 1 is a perspective diagram illustrating an embodiment of a collapsible exercise device. Device 100 may include support frame 113 configured, for example, as a U-shaped bar (rounded bar, angular bar or other applicable shaped frame bar). Support frame 113 may include two end section 115 and transverse section 117 defined transversely between two end sections 115 defined substantially parallel to each other. Headrest 119 may be defined (e.g. in a sleeve form) around a middle portion of transverse section 117. Headrest 119 may allow ground or body contacts for exercising support.

Device 100 may include one or more (e.g. a pair of) arched frames 101. Each arched frame 101 may include a single tube or bar curved in a manner to allow arched frame 101 to roll or rock along a ground. Alternatively, arched frame 101 may be smoothly shaped to facilitate hand holding, pulling or pushing. Each arched frame 101 may include support end 109 and grip end 111. Arched frame 101 may be formed between support end 109 and grip end 111 substantially along a two dimensional flat plane (or thin plate). Each arched frame may 101 may be rotatably coupled to one end section 115 of support frame 113 via support end 111.

In one embodiment, device 100 can include grip frame 103 defined as a tube or bar formed in a curved, straight or other applicable manner between pivot end 105 and control end 197. Grip frame 103 may be transversely affixed to arched frames 101 in a configurable manner. For example, pivot end 105 of grip frame 103 may be pivotably coupled to grip end 109 of one arched frame 101. Control end 107 of grip frame 103 may be detachably affixed grip end 109 of a separate arched frame 101.

According to certain embodiments, arched frame 101, support frame 113 and grip frame 103 may each shaped as one elongated structure (e.g. bar, tube, frame etc.) defined along a substantially two dimensional flat plane. Device 100 may be formed as a three dimensional structure via sequentially coupling together these elongates structures, such as arched frame 101, grip frame 103 and support frame 113.

Grip frame 103 and headrest 119 may be arranged to provide hand-holding and backrest support that allows the user to perform exercise movements rocking forward and backwards via ached frames 101 rolling over a ground. Alternatively or optionally, support frame 103 (e.g. via headrest 119) and grip ends 109 of arched frames 101 may be arranged to provide ground support to allow a user to perform exercise movements exerting push up forces on arched frames 101.

Device 100 may be set up into various configurations via a single control between, for example, grip frame 103 and one arched frame 101 without detaching rotatable couplings between other frames. For example, device 100 may be configured in an operating configuration when control end 107 of grip frame 103 is attached to grip end 109 of arched frame 101. A pair of arched frames 101 may be affixed substantially parallel to each other in the operating configuration to allow a user positioned in between arched frames 101 to perform exercise movements.

Alternatively or optionally, device 100 may be foldable into a collapsed configuration when control end 107 of grip frame 103 is detached from grip end 109 of arched frame 101. Rotatable or pivotable couplings between adjacent frames may allow arched frames 101, grip frame 103 and support frames 113 to be folded towards each other together to minimize or reduce the storage space required to accommodate these frame components. For example, arched frames 101 may be substantially stacked together crossing each other in the collapsed configuration. Arched frames 101, support frame 103 and grip frame 113 can remain coupled/connected in the collapsed configuration.

In some embodiments, device 100 can include a sequence of bars, such as arched frames 101, support frame 113 and grip frame 103, coupled in a circular sequence to form a three dimensional bar. In other words, these frames are coupled to form a closed loop in an operating configuration. A control mechanism can detach one coupling connection between adjacent frames (e.g. without detaching other coupling connections) to open the close loop (of the frames) to allow these frames to pivot/rotate between each other and collapse together in a collapsed configuration to reduce amount of storage space required to accommodate device 100.

Figure 2:
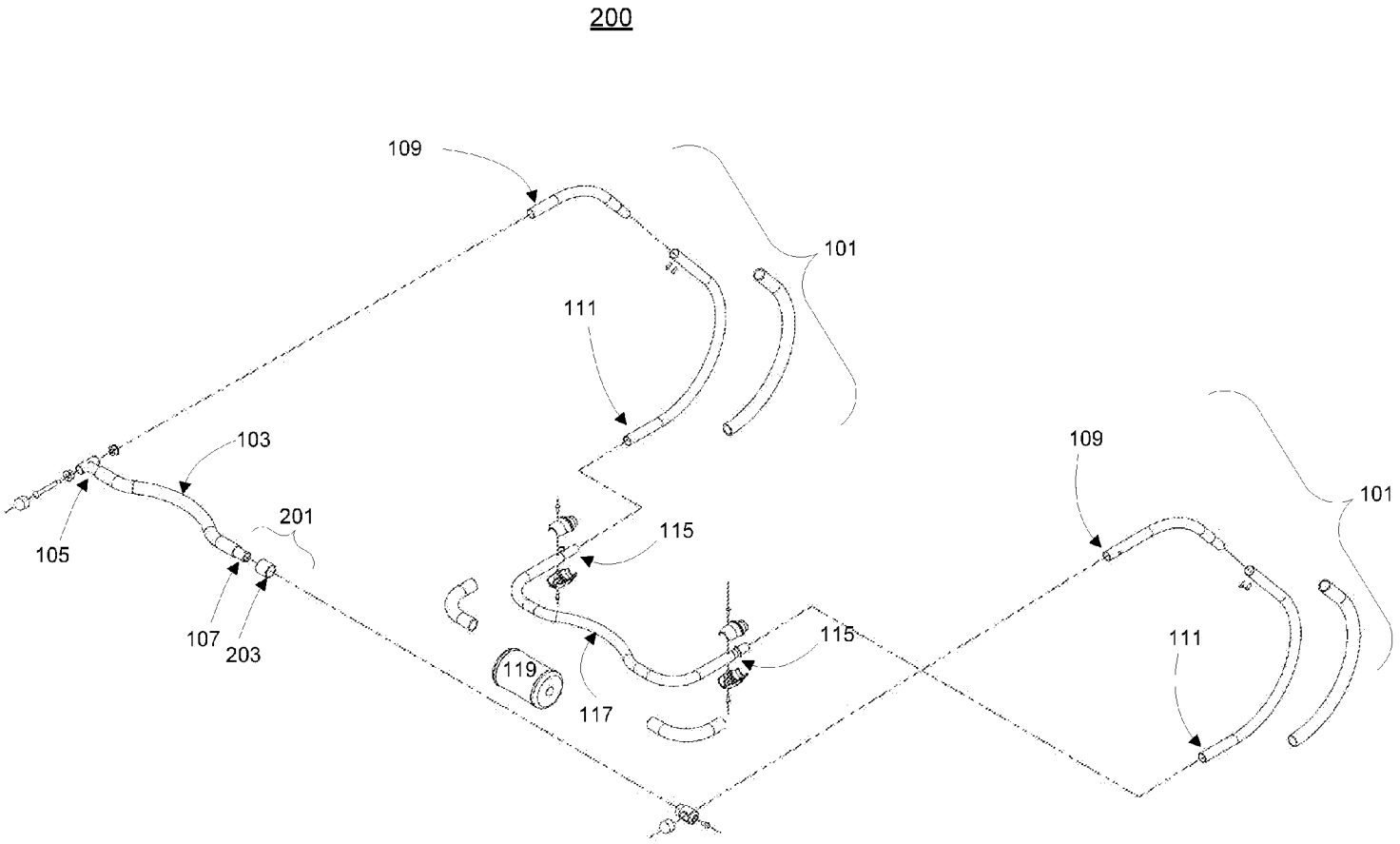
FIG. 2 is a component diagram illustrating an embodiment of a collapsible exercise device.

FIG. 2 is a component diagram illustrating an embodiment of a collapsible exercise device. For example, view 200 may be based on device 100 of FIG. 1. In one embodiment, locking control mechanism 201 may be defined to allow detaching control end 107 of grip frame 103 from grip end 109 of arched frame 101. Alternatively, locking control mechanism 201 may allow affixing or attaching control end 107 of grip frame 103 to grip end 109 of arched frame 101 to establish the operating configuration of device 100. In one embodiment, locking control mechanism includes a twist lock (e.g. via lock ring 203) operable with simple locking/unlocking operations.

Figure 3B:
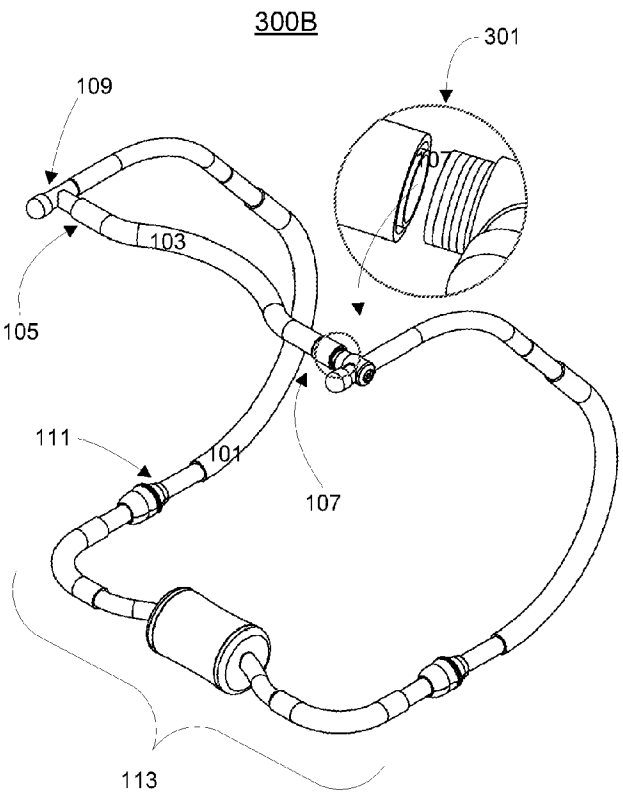
FIGS. 3A-3E are perspective diagrams illustrating a sequence of operations to assemble/dissemble a collapsible exercise device according to one embodiment of the present invention.
Figure 3A:
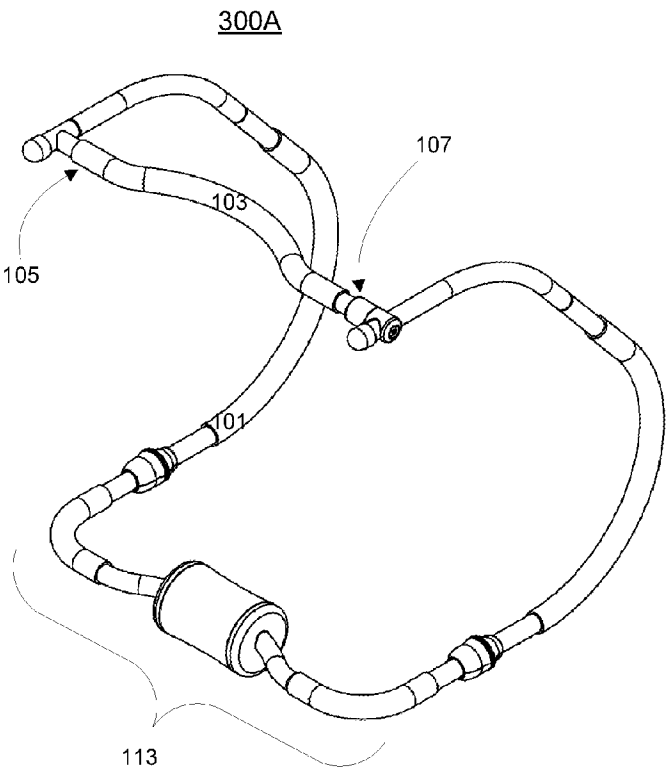

FIGS. 3A-3B are perspective diagrams illustrating a sequence of operations to assemble/dissemble a collapsible exercise device. For example, configurations 300A-300D may be based on device 100 of FIG. 1. Turning now to FIG. 3A, configuration 300A may indicate an exercising device assembled in an operating configuration with grip frame 103 and arched frame 101 tightly coupled via a locking mechanism.

Turning now to FIG. 3B, configuration 300B may indicate a first step to dissemble or collapse the exercise device from the operating configuration (or the last step to assemble or assemble the exercise device to the operation configuration). For example, the locking mechanism may be unlocked (or unscrewed) between grip frame 103 and arched frame 101 as demonstrated in illustration 301.

Figure 3D:
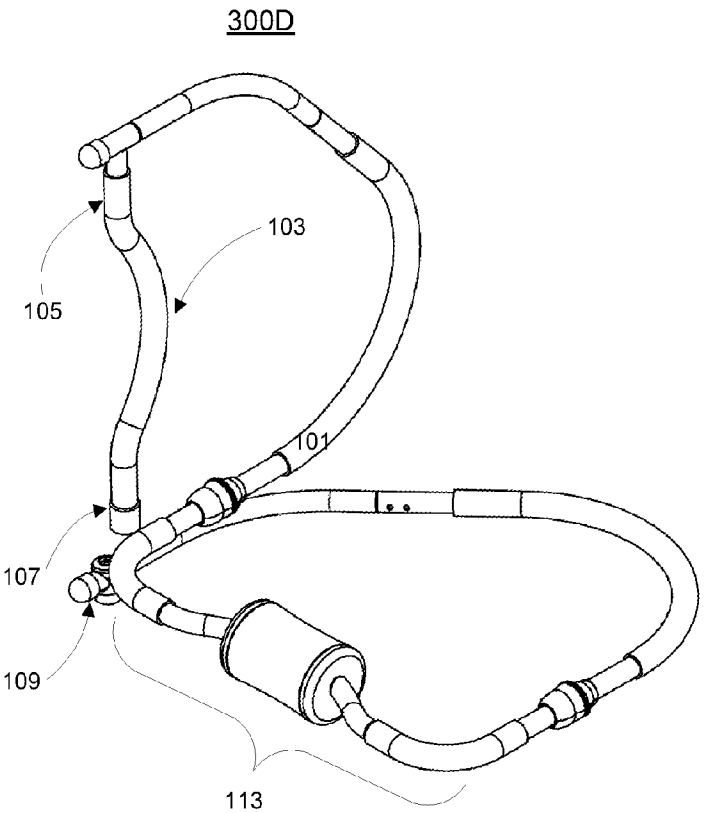
Figure 3C:
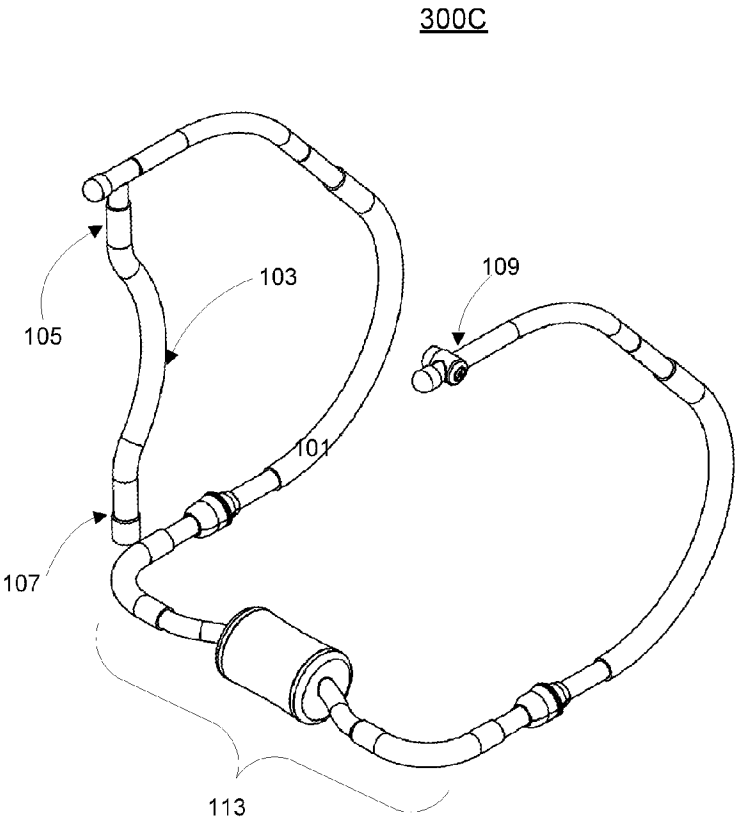

Subsequently, as shown in FIG. 3C, grip frame 103 with control end detached from an arched frame 101 may be allowed to pivot around grip end 109 of a separate arched frame 101 towards support end 111 of this separate arched frame 101 after grip frame 103 is unlocked from arched frame 101.

Turning now to FIG. 3D, one of a pair of arched frames 101 may be folded rotatably around support frame 113 towards another one (or each other) of the pair of arched frames 101. In one embodiment, a dimension of arched frame 101 (e.g. straight distance) between grip end 109 and support end 111 may be defined to conform substantially with (e.g. sizable enough to contain) a dimension (e.g. length) of grip frame 103 (e.g. between pivot end 105 and control end 107) to allow grip frame 103 to be folded or accommodated between two ends (grip end 109 and support end 111) of arched frame 101 in the collapsed configuration.

Figure 3E:
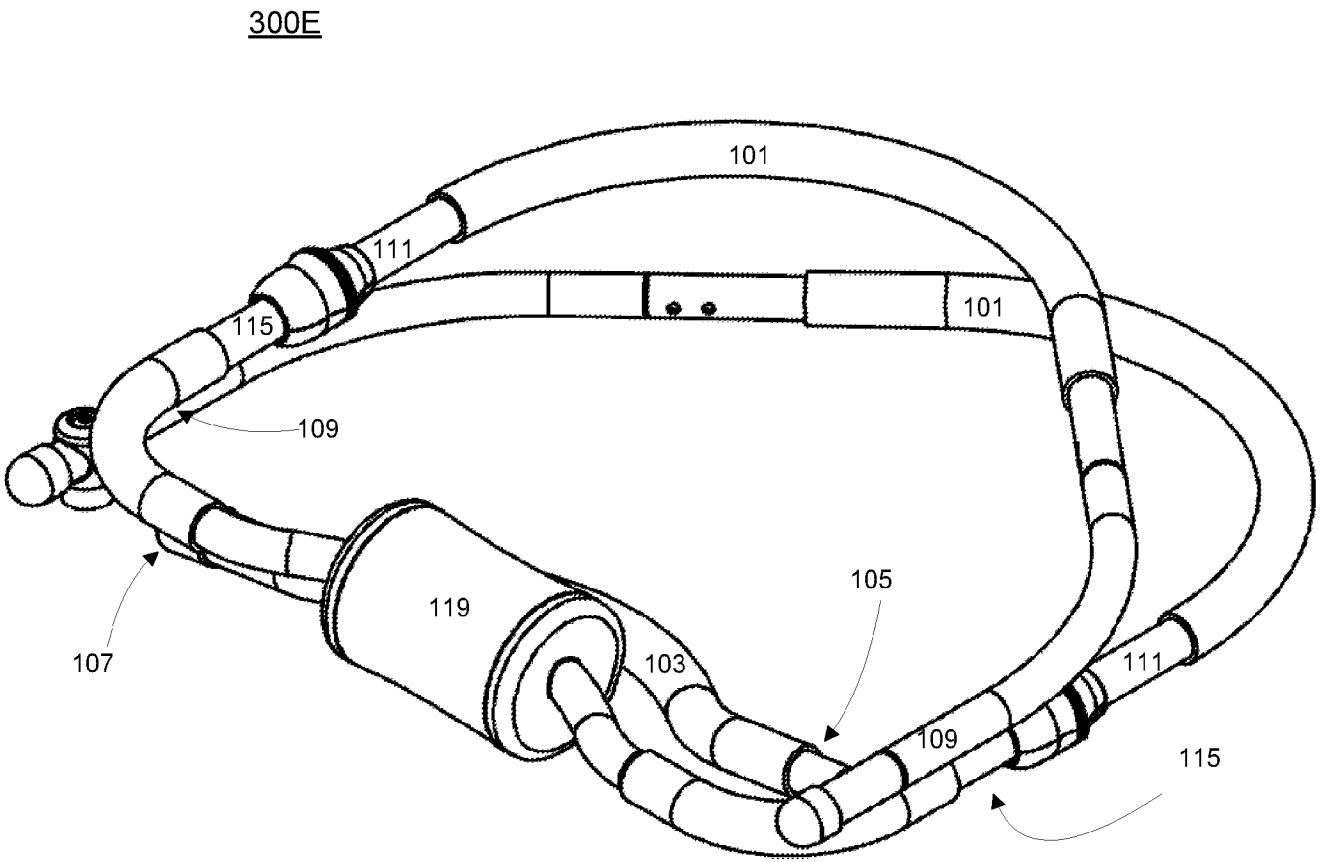

In FIG. 3E, configuration 300E may correspond to a collapsed configuration of an exercise device, for example, with arched frames 101 folded towards each other separately around support ends 111 after folding grip frame 103 is detached from one arched 101 via control end 107. Support frame 113 and arched frames 101 may be stacked on top of each other in configuration 300E to reduced a height dimension of the storage space for device 100 to about twice the thickness of arched frame (or frame bar) 101. Arched frame 101, grip frame 103 and support frame 113 may be stacked on top of each other in an interleaving manner. In one embodiment, grip frame 103 may be curved substantially confirming to headrest 119 to allow grip frame 103 to be placed sideway to support frame 113 in a collapsed configuration.

Figure 4A:
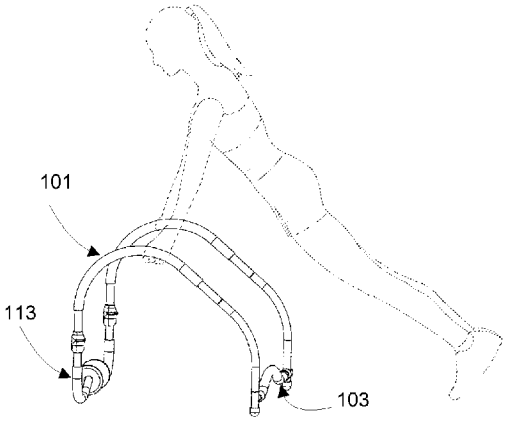
FIGS. 4A-4D show examples of an application of a collapsible exercise device according to one embodiment of the present invention.
Figure 4B:
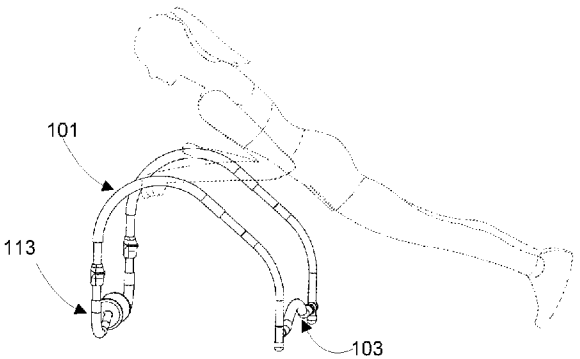
Figure 4C:
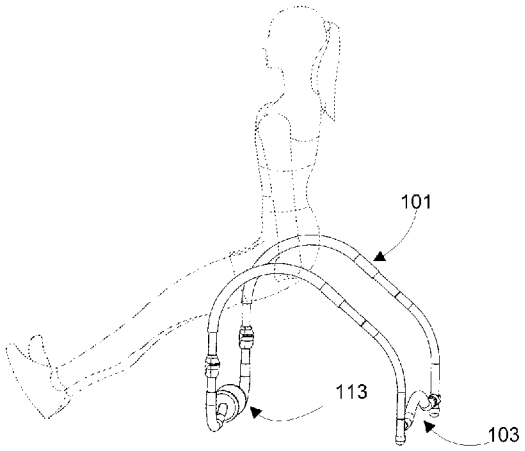
Figure 4D:
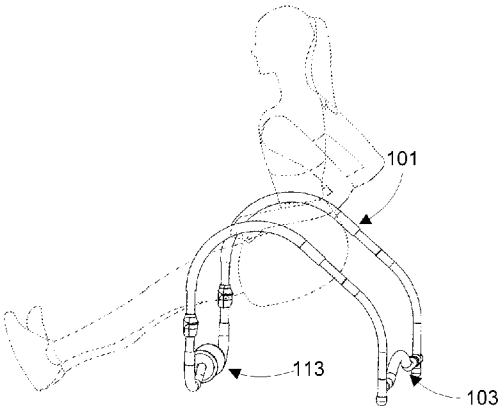

FIGS. 4A-4D show examples of an application of a collapsible exercise device, such as device 100 of FIG. 1. The exercise device may be assembled in an operating configuration and positioned with arched frames 101 on top of support frame 113 and grip frame 103. A user can perform forward leaning push-up exercise movements as illustrated in FIGS. 4A-4B. Alternatively, a user can use arms to move the lower body up and down to perform dip like exercise movements as illustrated in FIGS. 4C-4D.

Figure 5A:
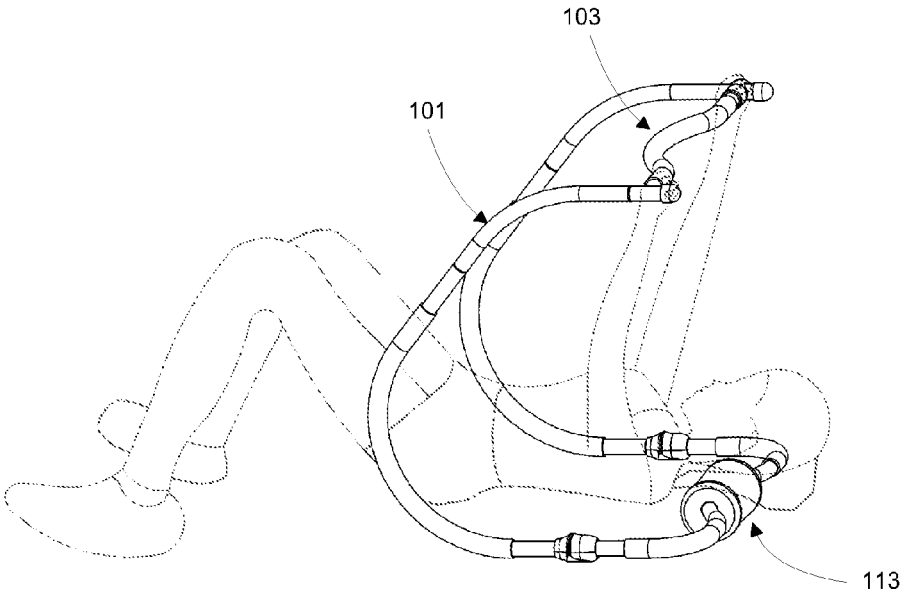
FIGS. 5A-5B show examples of an alternative application of a collapsible exercise device according to one embodiment of the present invention.
Figure 5B:
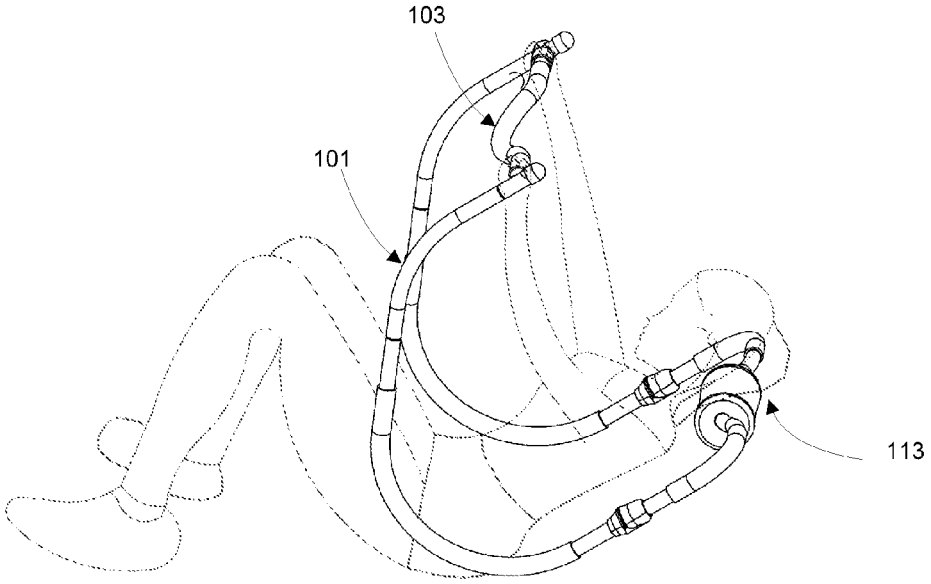

FIGS. 5A-5B show examples of an alternative application of a collapsible exercise device, such as device 100 of FIG. 1. As shown, a user lies back, between a pair of arched frames 101 of the exercise device, with head resting on a headrest of support frame 113. The user can exert forces with hands holding on grip frame 113 to rock the exercise device forward (e.g. as illustrated in FIG. 5B) and backward (e.g. as illustrated in FIG. 5A) via ached frames 101 rolling along a support ground to exercise waist and abdomen muscles.

Many modifications and other embodiments of the invention set forth herein will come to mind to one skilled in the art to which the invention pertains to having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An exercise machine comprising:

a support frame having two end section and a transverse section defined transversely between the two end sections, the two end sections defined substantially parallel to each other;

a pair of arched frames, each arched frame having a support end and a grip end, each arched frame rotatably coupled to one of the end sections via the support end;

a grip frame having a control end and a pivot end, the pivot end pivotably coupled to the grip end of one of the arched frames, the control end detachably affixed to the grip end of a separate one of the arched frames; and a locking control mechanism to detach or attach the control end of the grip frame from or to the grip end of the separate one arched frame, wherein when the control end of the grip frame is attached to the grip end of the separate arched frame, the arched frames are affixed in an operating configuration with the arched frames substantially parallel to each other to allow a user positioned in between the arched frames to perform exercise movements, and wherein when the control end of the grip frame is detached from the grip end of the separate arched frame, the arched frames, the grip frame and the support frames are foldable into a collapsed configuration, wherein the arched frames are substantially stacked together crossing each other in the collapsed configuration while the arched frames, the support frame and the grip frame remain coupled to each other.

2. The exercise machine of claim 1, wherein the control end of the grip frame is pivoted around the pivot end towards the support end of the one arched frame to fold the grip frame with the one arched frame for changing the operating configuration to the collapsed configuration.

3. The exercise machine of claim 2, wherein the arched frames are folded towards each other separately around the support ends subsequently to the folding of the grip frame and the one arched frame for changing the operating configuration to the collapsed configuration.

4. The exercise machine of claim 1, wherein a dimension of the one arched frame between the grip end and the support end is defined to conform substantially with a dimension of the grip frame between the pivot end and the control end to allow the grip frame to be accommodated between the support end and the grip end of the arched frame in the collapsed configuration.

5. The exercise machine of claim 1, wherein the locking control mechanism includes a twist lock.

6. The assembly of claim 1, wherein the support frame and the grip ends of the arched frames are arranged to provide ground support for the arched frames to allow the user to perform exercise movements exerting push up forces on the arched frames.

7. The assembly of claim 1, further comprising:

a headrest defined around the transverse section of the support frame, wherein the grip frame and the headrest are arranged to provide hand holding and backrest support to allow the user to perform exercise movements rocking forward and backwards via the ached frames rolling over a ground.

* * * * *